US010206510B2

(12) United States Patent
Choi

(10) Patent No.: US 10,206,510 B2
(45) Date of Patent: Feb. 19, 2019

(54) FOLDING CHAIR

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 24 days.

(21) Appl. No.: 14/735,854

(22) Filed: Jun. 10, 2015

(65) Prior Publication Data

US 2015/0359339 A1 Dec. 17, 2015

(30) Foreign Application Priority Data

Jun. 11, 2014 (CN) ..... 2014 2 0308555 U

(51) Int. Cl.
*A47D 1/02* (2006.01)
*A47C 4/28* (2006.01)

(52) U.S. Cl.
CPC ..... *A47C 4/286* (2013.01); *A47D 1/02* (2013.01)

(58) Field of Classification Search
CPC ..... A47C 4/286; A47D 1/02
USPC ..... 297/16.2, 16.1, 423.19, 42, 46, 55
See application file for complete search history.

(56) References Cited

U.S. PATENT DOCUMENTS 291,082 A 1/1884 Latour
2,459,843 A 1/1949 Scholander
2,712,349 A 7/1955 Le Voir
3,093,407 A 6/1963 Wilson
4,386,790 A * 6/1983 Kassai ..... B62B 7/08 280/42
4,613,185 A * 9/1986 Marchesini ..... A47C 4/20 297/39
5,356,107 A 10/1994 Sinohuiz
5,501,505 A 3/1996 Jablonski
5,527,089 A 6/1996 Charest
5,620,227 A 4/1997 Brune
5,851,052 A 12/1998 Gustafsson
5,893,605 A 4/1999 Chang
6,082,813 A 7/2000 Chen
6,179,374 B1 1/2001 Tang
6,247,749 B1 6/2001 Yu
6,302,479 B1 10/2001 Zheng
6,322,646 B1 11/2001 Chakrabarti et al.
6,454,348 B1 9/2002 Wu
(Continued)

FOREIGN PATENT DOCUMENTS

CN 201480624 U 5/2010
DE 195 40 528 A1 5/1996
WO WO 2005/112703 A1 12/2005

*Primary Examiner* — Syed A Islam
(74) *Attorney, Agent, or Firm* — Morgan, Lewis & Bockius LLP

(57) ABSTRACT

A folding chair includes a chair frame. The frame includes left and right side stands, front and rear cross supporting rod assemblies, seat rods, backrest rods and left and right side upright poles. Each side stand includes a front leg that leans backward and a rear leg that is coupled to the front leg and supports the front leg. The front or rear cross supporting rod assembly includes two front cross supporting rods. The seat rods are connected to the front legs, rear legs and upright poles. The backrest rods are connected to the rear legs. The upright poles are movably connected to the front legs.

12 Claims, 3 Drawing Sheets

(56) References Cited

U.S. PATENT DOCUMENTS

| | | | | |
|---|---|---|---|---|
| 6,634,705 | B1 * | 10/2003 | Zheng | A47C 4/286 297/41 |
| 6,752,414 | B1 | 6/2004 | Waldron et al. | |
| 6,840,573 | B1 | 1/2005 | Yao | |
| 6,926,356 | B2 * | 8/2005 | Chen | A47C 4/42 297/35 |
| 7,011,372 | B1 | 3/2006 | Hsieh | |
| 7,404,601 | B2 | 7/2008 | Chen | |
| 7,717,502 | B2 | 5/2010 | Deng | |
| 7,717,503 | B1 | 5/2010 | Watson | |
| 7,758,111 | B2 | 7/2010 | Chen | |
| 8,100,469 | B2 * | 1/2012 | Lougee | A47C 4/286 297/452.3 |
| 8,303,032 | B1 | 11/2012 | Platta | |
| 8,465,090 | B1 | 6/2013 | O'Connor | |
| 8,511,747 | B2 * | 8/2013 | Lougee | A47C 4/286 297/16.2 |
| 9,204,729 | B2 * | 12/2015 | Frankel | A47C 1/14 |
| 9,585,481 | B2 | 3/2017 | Choi | |
| 2002/0024240 | A1 | 2/2002 | Chen | |
| 2004/0135405 | A1 | 7/2004 | Zheng | |
| 2006/0249991 | A1 | 11/2006 | Hsieh | |
| 2010/0237665 | A1 * | 9/2010 | Grace | A47C 4/286 297/16.2 |
| 2010/0308042 | A1 | 12/2010 | Faris | |
| 2011/0248037 | A1 | 10/2011 | Fung | |
| 2011/0248040 | A1 | 10/2011 | McGregor | |
| 2011/0303659 | A1 | 12/2011 | Perlman | |
| 2013/0264340 | A1 | 10/2013 | Zens | |
| 2016/0296023 | A1 * | 10/2016 | Choi | A47C 4/286 |

* cited by examiner

FOLDING CHAIR

CROSS-REFERENCE TO RELATED APPLICATION

The present application claims priority to Chinese Utility Model Application Number 201420308555.8 filed on Jun. 11, 2014, the entire contents of which are incorporated herein by reference for all purposes.

FIELD OF INVENTION

The present invention relates to a chair, and in particular, to a folding chair.

DESCRIPTION OF RELATED ART

There are a variety of folding chairs. Folding chairs are easy to store and carry, and are regular household articles people use in their homes. At present, a common folding chair includes a chair frame, a seat, and a backrest, and the whole chair can be folded. The folding chair may use cross-connected supporting rods between vertical support rods, where an upper end portion and a lower end portion of the supporting rod are connected to a pivot seat at the middle of the support rod and a base at the bottom of the support rod respectively, and folding and unfolding of the support rods are implemented by means of unfolding or retraction of the cross-connected supporting rods between support frames, so that the chair frame can be unfolded for use or folded entirely. Alternatively, in a simpler folding chair, front and rear cross legs form a support plane of the seat, and the rear leg is extended to form the backrest; when the folding chair is used, the two legs are directly unfolded or folded in a cross manner.

In terms of the common folding chair structures described above, the rear support leg that serves as the backrest is usually long, and after the whole chair frame is folded, the length of the support rod determines the size of the folded chair. However, the folded rod member is still relatively high and has a relatively large size, which is unfavorable for storage and transportation.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

An object of the present invention is to provide a folding chair, in which the length of the chair frame does not increase when the chair is folded, and the size of the folded chair is small, which facilitates storage and transportation.

In various embodiments, the present invention provides a folding chair including a chair frame. The chair frame includes a leg frame comprising a left side stand, a right side stand, a front cross supporting rod assembly disposed at a front facade and a rear cross supporting rod assembly disposed at a rear façade, wherein each of the left and right side stands comprises a front leg leaning backward and a rear leg coupled to the front leg at an upper portion of the front leg and supporting the front leg, the front cross supporting rod assembly comprises two front cross supporting rods, and the rear cross supporting rod assembly comprises two rear cross supporting rods. The chair frame also includes seat rods, each seat rod pivotally connected to a corresponding front leg of the leg frame, and a rear end of each seat rod pivotally connected to a corresponding rear leg of the leg frame; backrest rods, a lower end of each backrest rod pivotally connected to a corresponding rear leg of the leg frame; and a left side upright pole and a right side upright pole disposed at the front façade.

In one embodiment, lower ends of the left and right upright poles are movably and respectively connected to the corresponding front legs, the seat rods each are respectively connected to the corresponding left or right upright pole, lower ends of the front cross supporting rods respectively connected to the corresponding front legs at lower portions of the corresponding front legs, and upper ends of the front cross supporting rods respectively connected to the corresponding upright poles below the corresponding seat rods, and lower ends of the rear cross supporting rods respectively connected to the corresponding rear legs, and upper ends of the rear cross supporting rods respectively connected to the corresponding backrest rods.

In some embodiments, the chair frame further includes an armrest rod substantially parallel to a corresponding seat rod and located above the corresponding seat rod, wherein a front end of the armrest rod is connected to a top of a corresponding upright pole, and a rear end of the armrest rod is connected to a corresponding backrest rod.

In some embodiments, the chair frame further includes a connecting member disposed at a corresponding rear leg, wherein the rear end of a corresponding seat rod and the lower end of a corresponding backrest rod are pivotally connected to the connecting member.

In some aspects, the chair frame further includes a connecting member capable of sliding upward and downward disposed on a corresponding backrest rod, wherein an upper end of a corresponding front leg is connected to the connecting member.

In some embodiments, the chair frame further includes a connecting block provided at a corresponding seat rod at a position where the corresponding seat rod and a corresponding upright pole are cross-connected, wherein the connecting block is connected to a corresponding upright pole, and upper ends of the front cross supporting rods are connected to the connecting block.

In some embodiments, the chair frame further includes a connecting bar, wherein a first end of the connecting bar is pivotally connected to an upper end of a corresponding rear leg and a second end of the connecting bar is connected to a corresponding front leg.

With the structure described herein, in the folding chair structure of the present invention, the backrest rod is in linkage with the cross struts in the rear facade and the seat rod, and the backrest rod is connected to the rear leg, and will not become substantially longer when the chair frame is folded. The chair frame will not become substantially higher after being folded. During folding, the seat rod and the armrest rod are also cooperatively folded and moved to the front of the backrest rod, and the front facade of the chair frame is directly retracted backward, so that the rod members of the chair frame are retracted and become compact, and the folded chair frame is small in size, which facilitates storage and transportation.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
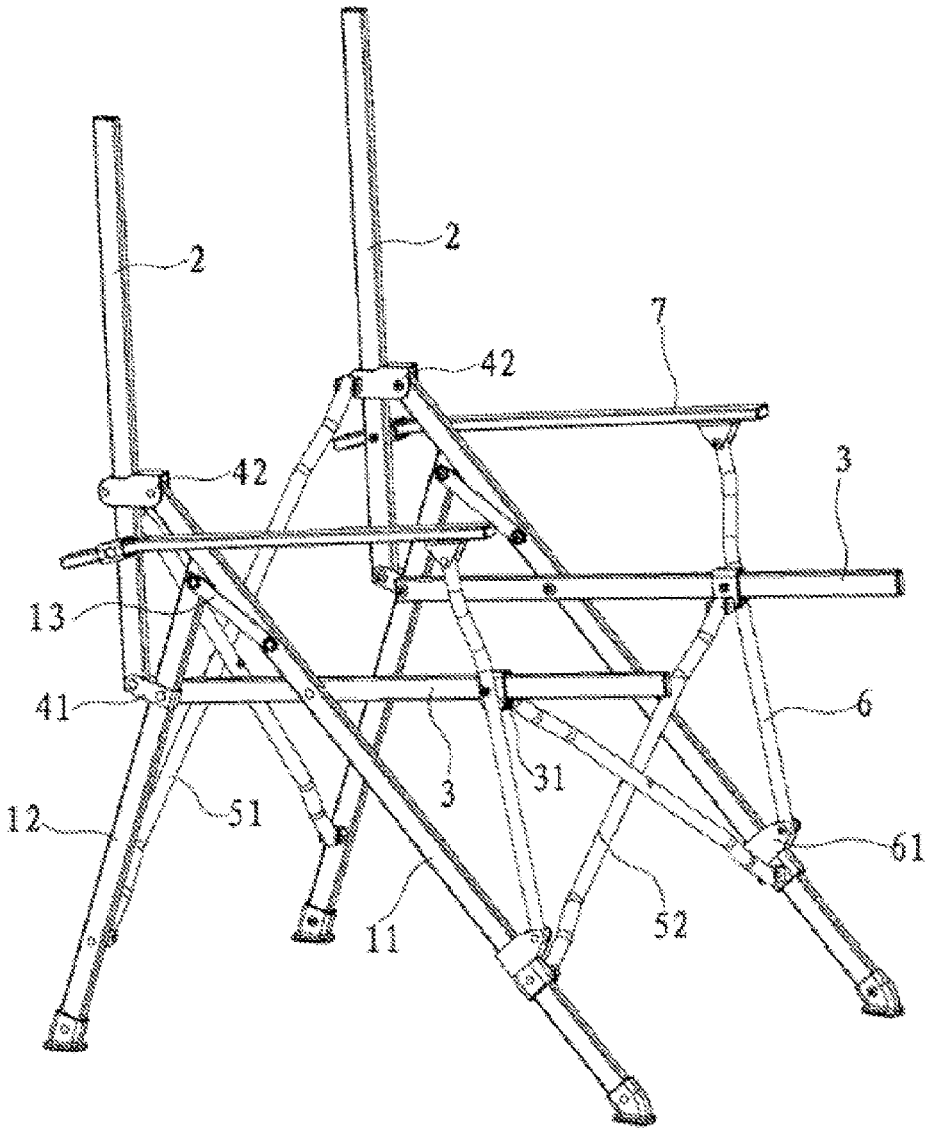
FIG. 1 is a schematic perspective view of an exemplary foldable chair in an unfolded state in accord with the present invention.

As shown in FIG. 1, a folding chair of the present invention includes a chair frame and a chair cloth connected thereon (Figure shows only the chair frame, and does not show the chair cloth). In various embodiments, the chair frame includes a leg frame, and seat rods and backrest rods that are connected to the leg frame, where the leg frame includes a side stand on each side and cross supporting rod assemblies that are in a front facade and a rear facade. In an exemplary embodiment, the side stand includes front leg 11 and rear leg 12, where front leg 11 leans and provides support against backward force. Rear leg 12 is supported on an upper portion of front leg 11 in a cross-wise manner, and front leg 11 and rear leg 12 support each other in a cross-wise manner. In some embodiments, connecting bar 13 is pivotally connected at an upper end of rear leg 12, and another end of connecting bar 13 is connected to front leg 11. When the chair frame is folded, front leg 11 is released from the support of the rear leg, and connected by the connecting bar, front leg 11 and rear leg 12 are retracted simultaneously in coordination with the folding of the chair frame.

Backrest rod 2 is pivotally connected to rear leg 12. Seat rod 3 connecting the chair cloth is pivotally connected to front leg 11 and rear leg 12 at the same time. A rear end of seat rod 3 and a lower end of backrest rod 2 are pivotally connected to rear leg 12. In some embodiments, connecting member 41 is disposed on rear leg 12, and the rear end of seat rod 3 and the lower end of backrest rod 2 are pivotally connected to connecting member 41. In some embodiments, connecting member 42, capable of sliding upward and/or downward, is disposed on backrest rod 2, and an upper end of front leg 11 is pivotally connected to connecting member 42.

In some embodiments, the front facade and the rear facade of the chair frame are also provided with the cross supporting rod assemblies, where one cross supporting rod assembly is connected between two rear legs 12. Lower ends of two cross supporting rods 51 in the cross supporting rod assembly are separately connected to rear legs 12, and upper ends of two cross supporting rods 51 are separately connected to backrest rods 2. An exemplary embodiment of the front facade of the chair frame is also provided with one cross supporting rod assembly. To coordinate with the connection of the cross supporting rod assembly, two sides of the front facade are further provided with upright poles 6. Connected front leg 11 on upright pole 6 is provided with upright pole 6, where a lower end of upright pole 6 is movably connected to front leg 11 through slider 61. Upright pole 6 extends upward, and seat rod 3 is connected to the upright pole.

Further, in some embodiments, armrest rod 7 is disposed in the chair frame, and is parallel or substantially parallel to and located above seat rod 3. A front end of armrest rod 7 is connected to the top of upright pole 6, and a rear end of the armrest rod 7 is connected to backrest rod 2. Lower ends of two cross supporting rods 52 are disposed in the front facade of the chair frame, and the lower ends of supporting rods 52 are separately connected to lower portions of front legs 11 and located below slider 61, while upper ends of supporting rods 52 are separately connected to upright poles 6 and located below seat rods 3. Seat rod 3 may be provided with connecting block 31 at a position where seat rod 3 and upright pole 6 are cross-connected. Upright pole 6 is connected to connecting block 31. The upper end of supporting rod 52 may also be connected to connecting block 31, so that the connection structure is simpler.

Figure 2:
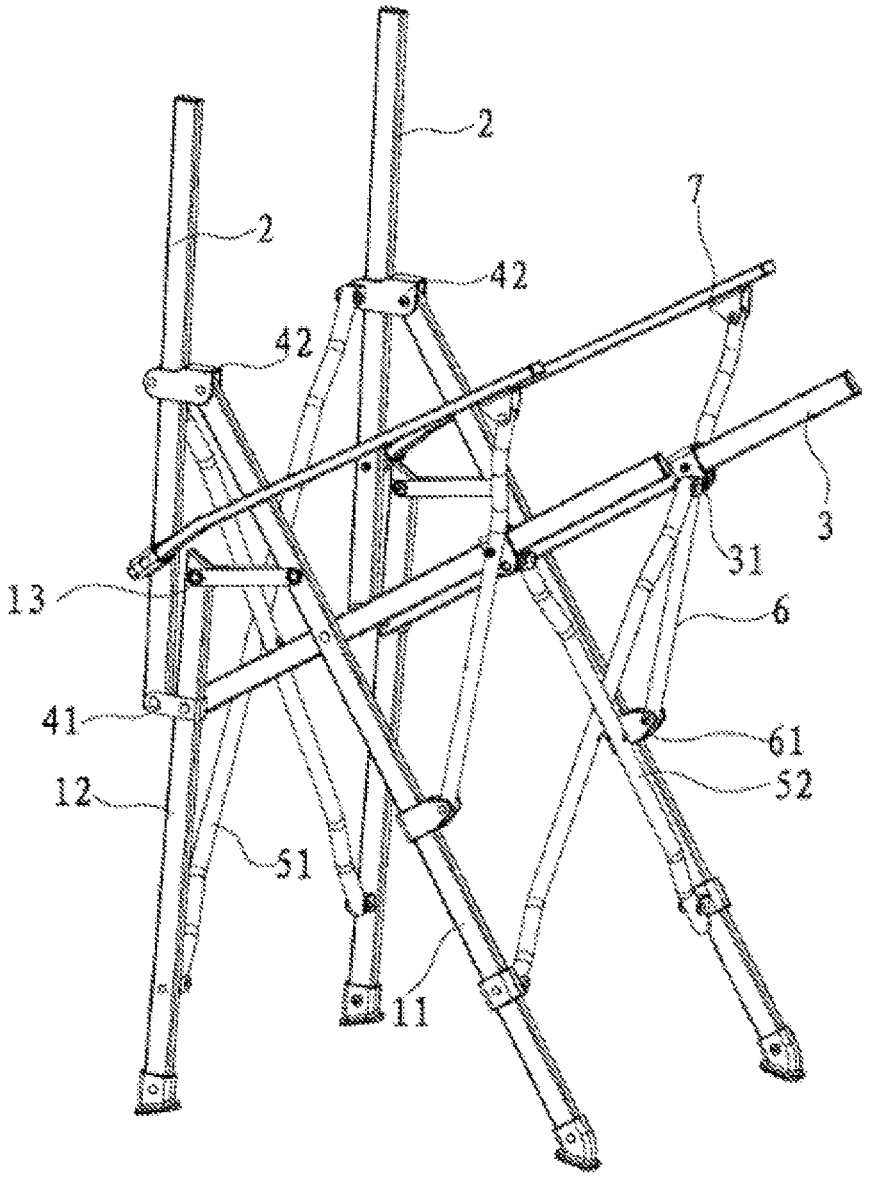
FIG. 2 is a schematic view of an exemplary foldable chair in a half-folded state in accord with the present invention.
Figure 3:
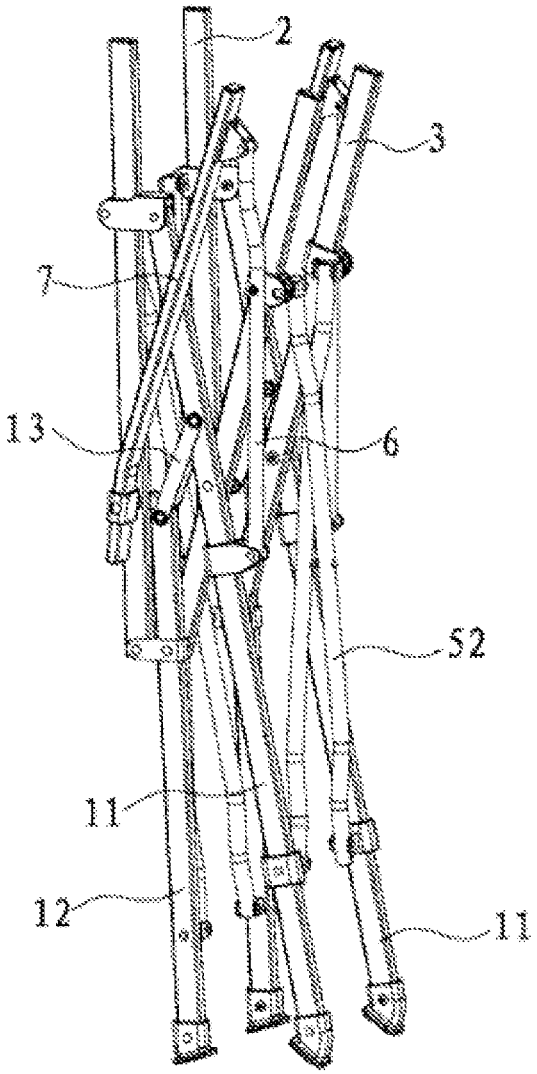
FIG. 3 is a schematic view of an exemplary foldable chair in a folded state in accord with the present invention.

The chair of the instant invention is deployed or folded for transport and/or storage by means of movable connections of the rod members, during folding of the chair frame of the present invention, as shown in FIG. 1 to FIG. 3. In an exemplary embodiment, the chair is operated as follows. Rear leg 12, supported in a slanted manner, is made to withdraw support for front leg 11 and move towards backrest rod 2 in a parallel or substantially parallel manner; then, front leg 11 is moved to rear leg 12. Front leg 11 and rear leg 12 move relative to each other by means of pivotal connection with connecting bar 13. During the retraction process, the cross supporting rod assemblies in the front facade and the rear facade are also retracted. Connecting member 42 moves upward on backrest rod 2. Seat rod 3 and armrest rod 7 are also retracted upward and move close to backrest rod 2. Upright pole 6 is also moved upward, and slider 61 moves upward in front leg 11. As shown in FIG. 3, front leg 11, seat rod 3, armrest rod 7, and upright pole 6 all move upward and retract backward, thereby folding the whole chair. On the contrary, by directly unfolding the seat rod, the armrest rod, and the front leg, which thereby causes the cross supporting rod assemblies to unfold and the rod members to unfold in a linked manner, the chair frame can be unfolded, supported, and ready to be used. The chair frame can also be retracted or unfolded easily, and is easy to use.

In an exemplary folding chair structure of the present invention, backrest rod 2 is in linkage with the cross struts in the rear facade and seat rod 3, and the backrest rod is connected to rear leg 12 and will not become substantially longer after the chair frame is folded; the chair frame will not become higher after being folded; during folding, the seat rod and the armrest rod are also folded and moved to the front of the backrest rod, and the front facade of the chair frame is directly retracted backward, so that the rod members of the chair frame are refracted and become compact, and the folded chair frame is small in size, which facilitates storage and transportation.

For convenience in explanation and accurate definition in the appended claims, the terms "upper" or "lower", "front" or "rear", "left" or "right", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A folding chair comprising:

a chair frame comprising:

a leg frame comprising a left side stand, a right side stand, a front cross supporting rod assembly disposed at a front facade and a rear cross supporting rod assembly disposed at a rear façade, wherein each of the left and right side stands comprises a front leg leaning backward and a rear leg coupled to the front leg at an upper portion of the front leg and supporting the front leg, the front cross supporting rod assembly comprises two front cross supporting rods, and the rear cross supporting rod assembly comprises two rear cross supporting rods;

seat rods, each seat rod pivotally connected to a corresponding front leg of the leg frame, and a rear end of each seat rod pivotally connected to a corresponding rear leg of the leg frame;

first connecting members, each fixedly disposed at a corresponding rear leg of the leg frame;

backrest rods, a lower end of each backrest rod pivotally connected to the first connecting member at the corresponding rear leg of the leg frame; and a left side upright pole and a right side upright pole disposed at the front facade, wherein lower ends of the left and right upright poles are movably and respectively connected to the corresponding front legs, the seat rods are respectively connected to the corresponding left and right upright poles, lower ends of the front cross supporting rods respectively connected to the corresponding front legs at lower portions of the corresponding front legs, and upper ends of the front cross supporting rods respectively connected to the corresponding upright poles below the corresponding seat rods, and lower ends of the rear cross supporting rods respectively connected to the corresponding rear legs, and upper ends of the rear cross supporting rods respectively connected to the corresponding backrest rods.

2. The folding chair according to claim 1, wherein the chair frame further comprises an armrest rod substantially parallel to a corresponding seat rod and located above the corresponding seat rod, wherein a front end of the armrest rod is connected to a top of a corresponding upright pole, and a rear end of the armrest rod is connected to a corresponding backrest rod.

3. The folding chair according to claim 1, wherein the rear end of each seat rod is pivotally connected to the corresponding rear leg of the leg frame by pivotally connecting to the first connecting member at the corresponding rear leg of the leg frame.

4. The folding chair according to claim 1, wherein the chair frame further comprises second connecting members, each connecting member slidably disposed on a corresponding backrest rod, wherein an upper end of each front leg is connected to the second connecting member at the corresponding backrest rod.

5. The folding chair according to claim 1, wherein the chair frame further comprises a connecting block provided at a corresponding seat rod, wherein a corresponding upright pole and the upper end of a corresponding front cross supporting rod are connected to the connecting block.

6. The folding chair according to claim 1, the chair frame further comprises a connecting bar, wherein a first end of the connecting bar is pivotally connected to an upper end of a corresponding rear leg and a second end of the connecting bar is connected to a corresponding front leg.

7. A chair frame for a folding chair, comprising:

a leg frame comprising a left side stand, a right side stand, a front cross supporting rod assembly disposed at a front facade and a rear cross supporting rod assembly disposed at a rear façade, wherein each of the left and right side stands comprises a front leg leaning backward and a rear leg coupled to the front leg at an upper portion of the front leg and supporting the front leg, the front cross supporting rod assembly comprises two front cross supporting rods, and the rear cross supporting rod assembly comprises two rear cross supporting rods;

seat rods, each seat rod pivotally connected to a corresponding front leg of the leg frame, and a rear end of each seat rod pivotally connected to a corresponding rear leg of the leg frame;

first connecting members, each fixedly disposed at a corresponding rear leg of the leg frame;

backrest rods, a lower end of each backrest rod pivotally connected to the first connecting member at the corresponding rear leg of the leg frame; and a left side upright pole and a right side upright pole disposed at the front facade, wherein lower ends of the left and right upright poles are movably and respectively connected to the corresponding front legs, the seat rods are respectively connected to the corresponding left and right upright poles, lower ends of the front cross supporting rods respectively connected to the corresponding front legs at lower portions of the corresponding front legs, and upper ends of the front cross supporting rods respectively connected to the corresponding upright poles below the corresponding seat rods, and lower ends of the rear cross supporting rods respectively connected to the corresponding rear legs, and upper ends of the rear cross supporting rods respectively connected to the corresponding backrest rods.

8. The chair frame according to claim 7, further comprises an armrest rod substantially parallel to a corresponding seat rod and located above the corresponding seat rod, wherein a front end of the armrest rod is connected to a top of a corresponding upright pole, and a rear end of the armrest rod is connected to a corresponding backrest rod.

9. The chair frame according to claim 7, wherein the rear end of each seat rod is pivotally connected to the corresponding rear leg of the leg frame by pivotally connecting to the first connecting member at the corresponding rear leg of the leg frame.

10. The chair frame according to claim 7, further comprises second connecting members, each connecting member slidably disposed on a corresponding backrest rod, wherein an upper end of each front leg is connected to the second connecting member at the corresponding backrest rod.

11. The chair frame according to claim 7, further comprises a connecting block provided at a corresponding seat rod, wherein a corresponding upright pole and the upper end of a corresponding front cross supporting rod are connected to the connecting block.

12. The chair frame according to claim 7, further comprises a connecting bar, wherein a first end of the connecting bar is pivotally connected to an upper end of a corresponding rear leg and a second end of the connecting bar is connected to a corresponding front leg.

* * * * *